United States Patent [19]
Sato et al.
[11] 4,308,168
[45] Dec. 29, 1981

[54] VAPOR PHASE CORROSION INHIBITOR COMPOSITIONS AND METHOD OF INHIBITING CORROSION USING SAID COMPOSITIONS

[75] Inventors: Haruhito Sato, Sodegaura; Keiji Osada, Narashino, both of Japan

[73] Assignee: Idemitsu Kosan Co., Ltd., Tokyo, Japan

[21] Appl. No.: 79,160

[22] Filed: Sep. 26, 1979

[30] Foreign Application Priority Data

Sep. 30, 1978 [JP] Japan ..... 53-121085

[51] Int. Cl.[3] ..... C09K 3/00
[52] U.S. Cl. ..... 252/389 R; 252/392; 252/391; 106/14.05; 106/14.31; 422/9
[58] Field of Search ..... 252/392, 389 R, 391, 252/390, 8.55 E, 13, 14, 34; 422/9, 10; 106/14.05, 14.31, 14.42, 14.43; 428/438, 440

[56] References Cited

U.S. PATENT DOCUMENTS

| | | | |
|---|---|---|---|
| 2,790,779 | 4/1957 | Spivack et al. | 252/392 |
| 3,773,479 | 11/1973 | Doin et al. | 252/392 |
| 3,785,975 | 1/1974 | Humphrey et al. | 252/392 |

*Primary Examiner*—Benjamin R. Padgett
*Assistant Examiner*—J. L. Barr
*Attorney, Agent, or Firm*—Frishauf, Holtz, Goodman & Woodward

[57] ABSTRACT

A method for inhibiting corrosion of metal by contacting the metal with a volatile alkyl ester of an amino acid. The invention also provides compositions containing these alkyl esters of amino acids as an active anti-corrosion inhibitor. These compositions may be fluid or semi-fluid compositions exemplified by oil-base compositions. The compositions may also be porous materials such as zeolite, silica gel, paper board, kraft paper, cloth, etc.

11 Claims, No Drawings

VAPOR PHASE CORROSION INHIBITOR COMPOSITIONS AND METHOD OF INHIBITING CORROSION USING SAID COMPOSITIONS

BACKGROUND OF THE INVENTION

The present invention provides vapor phase corrosion inhibitor compositions and provides a method for inhibiting the corrosion of metal by contacting said metal with an active vapor phase corrosion inhibitor.

Various products made of metal, such as steel products, tend to oxidize during their production, storage or transportation. In order to prevent or minimize this problem, corrosion inhibitors of various types have been used for many years. Relatively recently, vapor phase inhibitors have been used to coat the metal. Hitherto, dicyclohexylamine nitrate (trademark: DICHAN, chemical formula $(C_6H_{11})_2NH_2NO_2$) and a salt of dicyclohexylamine with a fatty acid (trademark: FERROGUARD) have been commercialized and used as the inhibitor.

These known inhibitors are disadvantageous because gas derived from them, especially from DICHAN, can diffuse by a distance of only about 30 cm. at ambient temperatures. DICHAN has no solubility in oil, so that it cannot be used by adding it to a mineral oil, such as lubricating oil, light oil and the like. Similarly, FERROGUARD is an organic salt and therefore only slightly soluble in mineral oil. Because of such poor solubility in oil, these anticorrosive substances cannot be added in a high concentration to an oil so as to prepare an oil base corrosion inhibitor. To the extent that oil base composition can be prepared, such preparation takes a long time. Additionally, they are disadvantageous because of the toxicity originated from their organic amine moiety. Finally, both of the aforediscussed substances promote the corrosion of a system in which a nonferrous metal is in contact with and/or alloyed with a ferrous metal, which limits the utility of such substances.

It is also known, for example from U.S. Pat. No. 2,790,779, that some amino acids can be used as a corrosion inhibitor. The amino acids have, however, no volatility and therefore are not suitable for use as a vapor phase inhibitor.

One object of this invention is to provide vapor phase inhibitor compositions having high volatility and excellent anti-corrosive characteristics.

Another object of the invention is to provide essentially non-toxic vapor phase inhibitor compositions.

A further object of the invention is to provide vapor phase inhibitor compositions which are easy to handle and have excellent anti-corrosion characteristics and which are readily prepared and to provide a method of protecting metal by applying said vapor phase inhibitors to the metal.

THE INVENTION

We have discovered that alkyl esters of amino acids are effective vapor phase corrosion inhibitors. The present invention provides a method of protecting metals by contacting the metal with at least one alkyl ester of an amino acid. These alkyl esters of amino acids are preferably incorporated as an active agent in an anti-corrosion composition containing an anti-corrosion composition carrier. The present invention also provides such compositions.

The alkyl esters of amino acids which are the effective active components are volatile esters of amino acids which form such volatile esters with an alkyl esterifying group and include, for example, an aliphatic amino acid, and an amino acid having an aromatic or heterocyclic nucleus. The aliphatic amino acids include monoamino-monocarboxylic acids such as glycine, α-alanine, valine, leucine, isoleucine, N-methylglycine and the like; sulphur-containing amino acids such as cysteine, cystine, methionine and the like; diaminomonocarboxylic acids such as lysine, alginine and the like; monoaminodicarboxylic acids such as glutamic acid and the like; and β-alanine and γ-aminobutyric acid. The amino acids having an aromatic nucleus include phenylalanine, tyrosine and the like. The amino acids having a heterocyclic nucleus include hystidine, tryptophane, proline, hydroxyproline and the like. Among the above amino acids, the aliphatic amino acids, preferably monoamino-monocarboxylic acids, e.g. glycine, α-alanine and the like are particularly preferred.

The alkyl esters of amino acids used in this invention may be derived from the aforementioned amino acids. In point of volatility, among these alkyl esters, there may be preferred in the first place primary alkyl esters such as the methyl or ethyl ester and the like and in the second place, secondary alkyl esters such as the isopropylester and the like. These esters, however, have a disadvantage in that they tend to self-condense (dimerization) to form diketopiperazine. However, when an amino acid is esterified with a tertiary alcohol, which prevents such self-condensation, the resulting tertiary alkyl ester exhibits prolonged duration of the vapor phase anti-corrosion effect. In this case, the alkyl group of the alkyl ester may contain an unrestricted number of carbon atoms, so long as the resultant amino acid ester is volatile so as to function as a vapor phase inhibitor, and in general, preferably from 4 to 7 carbon atoms with reference to the vapor pressure, durability, etc. Particularly, tert-butyl esters of the amino acids such as the tert-butyl esters of alanine, phenylalanine, glutamic acid and the like are preferred; the tert-butyl esters of α-alanine, β-alanine and glycine are the most preferred. The alkyl esters of the amino acids used in this invention are soluble in oil, although the solubility may vary, depending on the molecular structure. The alkyl esters of the amino acids having lower molecular weight such as tert-butyl esters of α-alanine, β-alanine and glycine are wholly soluble in water. The alkyl esters of the amino acids having higher molecular weight are not very soluble in water.

The alkyl ester of the amino acids, per se, can be used as a vapor phase corrosion inhibitor. It can also be incorporated in compositions, usually an oil-base composition. The alkyl esters can be impregnated into porous materials such as kraft paper, tarpaulin paper, paper board, silica gel, zeolite and the like. The alkyl esters also can be admixed with a carrier which sublimes. The alkyl esters can be used in combination with known corrosion inhibitors and/or a known vapor phase inhibitor. If desired, one or more additives such as antioxidants, high-pressure additives, viscosity index improver, anti-foaming agents, pour point depressants, detergent-dispersants, etc. may be incorporated into the alkyl ester-containing anti-corrosion composition.

Oils generally may be used as the base for oil-base anti-corrosion compositions, so long as the oil will hold the alkyl esters. The particular oil utilized is determined by the usual technical and commercial considerations, particularly the contemplated service. Such oils include lubricating oils, light oils, base oils for brake oil, base oils for antifreeze or synthetic lubricating oils such as synthetic hydrocarbon oils, hindered polyol esters and the like, ethylene glycol, various glycol ethers and organic silicone oils and the like.

The amount of the alkyl ester of the amino acid incorporated in the oil may vary within wide limits depending upon conditions such as the type of oil, the object of the application and the like, but in general, the amount should be at least 0.1 gram, preferably 0.3–3.0 grams per liter of oil. The alkyl ester of the amino acid is added in an amount of about 0.5–1.5 grams to 1 liter of hydraulic oil.

The vapor phase inhibitors of this invention can be applied in different ways depending on its formulation. For example, when the vapor phase inhibitor is prepared by adding the alkyl ester of the amino acid to oil to form an oil-base composition, the said composition can be applied to the surface of various products (usually metal) such as the inner wall of metal pipes by coating. The metal surface coated with the above vapor phase inhibitor is maintained rust-free, even if the coating is incompletely applied or the oil film is broken, because the vaporized alkyl ester of the amino acid protects the metal surface. When a small engine is run-in at the factory and then, after removing the oil, transported to delivery, the empty engine surfaces are liable to rust. However, when the vapor phase corrosion inhibitor of the invention is incorporated in the run-in oil, the engine is protected from rust.

The vapor phase inhibitor of this invention is distinguished by its high anti-corrosive ability and long diffusion distance of the gaseous (vaporized) alkyl ester of the amino acid. Furthermore, the vapor phase inhibitor of this invention corrodes neither iron nor non-ferrous metals and therefore, can be applied to any system, in which different metals are alloyed or are in contact (e.g. plated, or clad or coated), for example, mild steel, cast iron, chromium cast iron, 13-chrome stainless steel, die casting zinc, aluminum, corrosion-resistant aluminum, duralumin, alumite, tin plating, nickel plating, hard or bright chromium plating, cadmium plating, silver plating, molten solder dips, zinc plating, molten zinc dips, or a system in which copper, brass or phosphor bronze, etc., coexists with iron. In addition, the vapor phase inhibitor of this invention is distinguished by its good process ability and safety, since the alkyl ester of the amino acid is soluble in oil and non-toxic.

The invention is further disclosed by the following illustrative examples.

EXAMPLE 1

5 milliliters of conc. sulfuric acid was added to a suspension of 5 grams of phenylalanine in 50 milliliters of dioxane. The mixture was added to about an equivalent amount of liquefied isobutylene and then allowed to stand at room temperature in an autoclave for a whole day and night. The resulting solution was poured into an excess of a cold solution of 2 N sodium hydroxide to form the tert-butyl ester of phenylalanine which is thereafter extracted with ether. After distilling out the ether, the distillation of the residue under reduced pressure produced 4.7 grams of phenylalanine-tert-butylester (yield 70%) having a boiling point of 96° C./1 mmHg.

EXAMPLES 2 and 3

Following the procedure described in Example 1 but substituting N-methylglycine and proline, respectively, for phenylalanine, N-methylglycine-tert-butylester (Example 2) and proline-tert-butylester (Example 3) were obtained.

EXAMPLE 4

Into a suspension of 5 grams of α- alanine in 50 milliliters of absolute ethanol, dry gaseous hydrogen chloride was added for about one hour to saturate the suspension. After the reaction vessel was closed with a plug and left standing at room temperature for two days, the reaction mixture was concentrated under reduced pressure to obtain crystals which were then recrystallized from ethanol/ether to give 8.3 grams (yield 92%) of alanine ethyl ester hydrochloride (m.p. 76° C.). This hydrochloride was dissolved in water and ether was added to the resulting solution so as to give a liquid consisting of two layers. The aqueous layer was neutralized by adding slowly an aqueous solution of conc. caustic soda to the liquid while agitating. Thereafter, the upper ethereal layer was concentrated to obtain the α-alanine ethyl ester. The yield was 4.9 grams (75%). The boiling point of the obtained substance was 48° C./11 mmHg.

EXAMPLE 5

To 960 milliliters of tert-butyl acetate, 5.7 grams (64 millimoles) of α-alanine and then 11.76 grams (70.4 millimoles) of 60% perchloric acid were added and thereafter stirred at room temperature for four days. The resulting solution was cooled to 0° C. and extracted four times with 160 milliliters of 0.5 N aqueous solution of hydrochloric acid. The extract was neutralized with 6 N sodium hydroxide solution and was extracted twice with 400 milliliters of ethyl ether. The ethereal layer was dried over anhydrous sodium sulfate and ether was distilled out. By distilling under reduced pressure, 5.22 grams of α-alanine-tert-butylester (yield 56%) was obtained. The boiling point of the obtained substance was 61° C./21 mmHg.

EXAMPLE 6

Following the procedure described in Example 5 but substituting glycine for alanine, the tert-butyl ester of glycine was obtained.

EXAMPLE 7

25 grams (0.28 mole) of β-alanine and 41.6 grams (0.28 mole) of phthalic anhydride were heated at 150° C. while stirring for three hours and then cooled. On recrystallizing with ethyl acetate, N-phthalyl-β-alanine was obtained in 90% yield (55 grams).

17.5 grams (80 millimoles) of the so-obtained N-phthalyl-β-alanine was dissolved in 80 milliliters of dry pyridine and then 200 milliliters of dry tert-butanol was added to this solution. Then, 8.8 milliliters (96 millimoles) of phosphorus oxychloride was dropwise added with vigorous stirring at −5° C. over thirty minutes. Thereafter, the reaction mixture was stirred at room temperature for three hours and then 400 milliliters of ethyl ether and 400 milliliters of water was added to it. The ethereal layer was washed with 400 milliliters of 1 N hydrochloric acid solution, 400 milliliters of 2% aqueous solution of sodium hydrogencarbonate and then 100 milliliters of water successively, and dried over anhydrous sodium sulfate. On distilling out ethyl ether, while needles of N-phthalyl-β-alanine-tert-butylester were obtained in 55% yield (12 grams).

A solution of 12 grams (44 millimoles) of this N-phthalyl-β-alanine-tert-butylester in 100 milliliters of methanol was mixed with 2.5 grams (50 millimoles) of hydrazine hydrate and heated at 60° C. for one hour. After distilling out the solvent and adding 150 milliliters of 2 N acetic acid solution, insoluble phthalyl hydrazine was filtered off. The filtrate was neutralied with 4 N sodium hydroxide, extracted with ethyl ether and then dried over anhydrous sodium sulfate. After distilling out ether, the distillation of the residue under reduced pressure gave 4.4 grams of β-alanine-tert-butylester (yield 70%) having a boiling point of 80° C./25 mmHg.

EXAMPLE 8

A laboratory dish containing 20 milligrams of each sample obtained in the preceding Examples was added to a 5-liter glass vessel containing 50 milliliters of 30% aqueous solution of glycerin.

A piece of polished carbon steel (JIS G-4051) was arranged at the upper part of the vessel, at a distance of 25 centimeters from the dish. After keeping the vessel at 20°±2° C. during 1–5 days, water droplets were condensed on a surface of steel from moisture by pouring cold water into an aluminum pipe, and after 5 hours the presence of the rust on the steel piece was observed. The results are shown in Table 1.

TABLE 1

| Substance | after leaving for 1 day* | after leaving for 5 days* |
|---|---|---|
| phenylalanine-tert-butyl ester | o | o |
| N-methylglycine-tert-butyl ester | o | o |
| proline-tert-butyl ester | o | o |
| α-alanine ethyl ester | o | o |
| α-alanine-tert-butyl ester | o | o |
| glycine-tert-butyl ester | o | o |
| β-alanine-tert-butyl ester | o | o |
| DICHAN | x | x |

*o = The amount of the rust is less than that in the blank test.
x = The amount of the rust is the same as that in the blank test.

EXAMPLE 9

Specifics of the chemicals listed in Table 2 were administered orally in various concentration to respective groups of 10 rats weighing 90 grams after fasting for 24 hours.

After oral administration of the chemical, the rats were fed with a sufficient amount of a diet and water and kept in a thermo-hygrostat at a temperature of 25° C. and humidity of 60% during one week to determine the $LD_{50}$. The results are reported in Table 2.

TABLE 2

| Drug | $LD_{50}$ (milligrams/kilo grams) |
|---|---|
| proline-tert-butyl ester | more than 5000 |
| α-alanine ethyl ester | more than 5000 |
| DICHAN | 200 |
| dicyclohexylamine | 500 |

EXAMPLE 10

The following vapor phase inhibitor compositions were prepared:

Sample I:
solution of 25 milligrams of α-alanine-tert-butylester in 25 milliliters of white spindle oil.

Sample II:
solution of 25 milligrams of β-alanine-tert-butylester in 25 milliliters of white spindle oil.

Sample III:
solution of 25 milligrams of glycine-tert-butylester in 25 milliliters of white spindle oil.

Comparative Sample I:
Solution of 25 milligrams of dicyclohexylamine octanoate in 25 milliliters of white spindle oil, and Comparative Sample II:
White spindle oil without additives.

Carbon steel S15C (JIS G4051) was used as the test pieces. The above Samples were subjected to the vapor phase inhibition test according to the procedure described in JIS Z 0236-6.7 (vapor phase inhibition). The results are shown in Table 3.

The white spindle oil described above has specific gravity of 0.893 (15/4° C.) and viscosity of 12.74 centistokes (cSt) (30° C.) and 6.472 cSt (50° C.); it is colorless and transparent.

TABLE 3

| Sample | Condition of Test Piece* |
|---|---|
| Sample I | – |
| Sample II | – |
| Sample III | – |
| Comparative Sample I | ++ |
| Comparative Sample II | ++ |

*–: The surface of the test piece was rustless.
+: A little portion of the surface got rusty.
++: The whole surface got rusty.

EXAMPLE 11

Employing the same vapor phase inhibitors and test pieces as described in Example 10, each sample (inhibitor) was subjected to the vapor phase inhibition test according to the procedure described in JIS Z 0236–6.9 (vapor phase inhibition after heating). The results are summarized in Table 4.

TABLE 4

| Sample | Condition of Test Piece* |
|---|---|
| Sample I | – |
| Sample II | – |
| Sample III | – |
| Comparative Sample I | + |
| Comparative Sample II | ++ |

*Same criteria as in Example 10.

EXAMPLE 12

Employing the same vapor phase inhibitors as described in Example 10 and the steel plate defined in JIS G 3141, the copper plate defined in JIS H 3104, the brass plate defined in JIS H 3202 and the aluminum plate defined as the 2024 plate in JIS H 4000, the samples of the inhibitors were subjected to the anti-corrosion test according to the procedure described in JIS Z 0236–5.11 (corrosion test by dipping). The results are summarized in Table 5.

TABLE 5

| Sample | Kind of Test Piece | Mass Change (milligram/$cm^2$) |
|---|---|---|
| Sample I | steel | 0.032 |
| | copper | 0.008 |
| | brass | 0.016 |
| | aluminum | 0.024 |

TABLE 5-continued

| Sample | Kind of Test Piece | Mass Change (milligram/cm$^2$) |
|---|---|---|
| Comparative Sample I | steel | 0.008 |
| | copper | 0.12 |
| | brass | 0.904 |
| | aluminum | 0.024 |

The anti-corrosion inhibitors and compositions of the present invention prevent or at least minimize corrosion attack by the effect of the contact of the alkyl ester of the amino acid with the metal being protected. This contact may solely be contact of the vapor (gaseous) alkyl ester of the amino acid with the metal which may be provided by placing a volatilizable alkyl ester of the amino acid in the vicinity of the metal to be protected, for example placing it in a closed container with the metal, for example, admixed with a porous carrier such as a silica gel or zeolite. It may also be impregnated into a porous packaging material such as kraft paper, etc.

The alkyl ester of the amino acids will also be incorporated into oil base compositions (using the term oil to include greases) which are applied to the metal which is being protected. Thus, a grease composition would substantially but not necessarily completely coat the surface of the metal. When the alkyl ester of the amino acid is incorporated in a lubricating or hydraulic fluid, it protects all of the surfaces which the fluid comes into contact with during operation and storage of the machine in which it is used. Because the alkyl esters of the amino acids are effective as anti-corrosion agents in the vapor form, they have the advantage that the composition in which they are incorporated need not contact every surface or part of the metal which is being protected. The alkyl esters of the amino acids are also effective in protecting metal on which water droplets have formed as a consequence of the condensation of a small amount of water in the machine system. The alkyl esters of the amino acids penetrate into such droplets in the form of vapor or in solution contact therewith and provide an anti-corrosion effect.

What is claimed is:

1. The method of inhibiting corrosion of a metal comprising contacting said metal with an amount of a volatile alkyl ester of an amino acid sufficient to inhibit corrosion of said metal, the alkyl group of said acid containing not more than 7 carbon atoms and said amino acid is at least one selected from the group consisting of glycine, α-alanine, valine, leucine, isoleucine, N-methylglycine, cysteine, cystine, methionine, lysine, arginine, glutamic acid, β-alanine, γ-aminobutyric acid, phenylalanine, tyrosine, hystidine, tryptophane, proline and hydroxyproline.

2. The method of claim 1, wherein said alkyl ester of an amino acid is at least one ester selected from the group consisting of α-alanine-tert-butylester, β-alanine-tert-butylester, glycine-tert-butylester, phenylalanine-tert-butylester, N-methylglycine-tert-butylester, proline-tert-butylester and α-alanine-ethylester.

3. A vapor phase corrosion inhibitor composition consisting essentially of an effective amount of an alkyl ester of an amino acid as the active vapor phase corrosion inhibitor component, and an anti-corrosion composition carrier, the alkyl group of said amino acid containing not more than 7 carbon atoms said amino acid is at least one selected from the group consisting of glycine, α-alanine, valine, leucine, isoleucine, N-methylglycine, cysteine, cystine, methionine, lysine, arginine, glutamic acid, β-alanine, γ-aminobutyric acid, phenylalanine, tyrosine, hystidine, tryptophane, proline, and hydroxyproline, said anti-corrosion carrier being selected from (i) a porous material selected from the group consisting of kraft paper, cloth, paperboard, tarpaulin paper, silica gel, and zeolites, or (ii) an oil selected from the group consisting of lubricating oil, light oil, synthetic hydrocarbon oil, ethylene glycol, glycol ether, and organic silicone oil.

4. The composition of claim 3 wherein said alkyl group of said amino acid is a tertiary alkyl group containing 4–7 carbon atoms.

5. The composition of claim 4 wherein said alkyl group of said amino acid is a teriary alkyl group containing 4–7 carbon atoms.

6. The composition of any one of claims 3, 4 and 5 wherein said carrier is a porous material.

7. The composition of any one of claims 3, 4 and 5 wherein said carrier is an oil.

8. The composition of claim 7 consisting essentially of between 0.3 and 3 grams of said alkyl ester of an amino acid per liter of said oil.

9. The composition of claim 8 wherein said alkyl ester of an amino acid is at least one ester selected from the group consisting of α-alanine-tert-butylester, β-alanine-tert-butylester, glycine-tert-butylester, phenylalanine-tert-butylester, N-methylglycine-tert-butylester, proline-tert-butylester and α-alanine-ethylester.

10. The composition of claim 6 wherein said alkyl ester of an amino acid is at least one ester selected from the group consisting of α-alanine-tert-butylester, β-alanine-tert-butylester, glycine-tert-butylester, phenylalanine-tert-butylester, N-methylgycine-tert-butylester, proline-tert-butylester and α-alanine-ethylester.

11. The composition of claim 3 wherein said alkyl ester of an amino acid is at least one ester selected from the group consisting of α-alanine-tert-butylester, β-alanine-tert-butylester, glycine-tert-butylester, phenylalanine-tert-butylester, N-methylgycine-tert-butylester, proline-tert-butylester and α-alanine-ethylester.

* * * * *